US011819472B2

(12) United States Patent
Yoskowitz

(10) Patent No.: US 11,819,472 B2
(45) Date of Patent: Nov. 21, 2023

(54) PACIFIER FOR COOLING OF ORAL TISSUE

(71) Applicant: ChemoMouthPiece, LLC, Closter, NJ (US)

(72) Inventor: David Yoskowitz, Woodcliff Lake, NJ (US)

(73) Assignee: CHEMOMOUTHPIECE, LLC, Closter, NJ (US)

( * ) Notice: Subject to any disclaimer, the term of this patent is extended or adjusted under 35 U.S.C. 154(b) by 324 days.

(21) Appl. No.: 17/115,159

(22) Filed: Dec. 8, 2020

(65) Prior Publication Data

US 2021/0177705 A1 Jun. 17, 2021

Related U.S. Application Data

(60) Provisional application No. 62/946,833, filed on Dec. 11, 2019.

(51) Int. Cl.
*A61J 17/00* (2006.01)

(52) U.S. Cl.
CPC ..... *A61J 17/001* (2015.05); *A61J 2200/44* (2013.01)

(58) Field of Classification Search
CPC ... F25D 3/00; F25D 3/005; F25D 3/02; F25D 3/06; F25D 3/08; A61J 17/001; A61J 2200/44; A61J 17/02; A61J 17/113; A61J 17/10; A61J 17/105; A61J 17/107; A61J 17/00
See application file for complete search history.

(56) References Cited

U.S. PATENT DOCUMENTS

| | | | | |
|---|---|---|---|---|
| 2,612,165 A | | 9/1952 | Szuderski | |
| 2,661,001 A | * | 12/1953 | Alstadt | A61J 11/00 215/11.5 |
| 3,267,937 A | | 8/1966 | Verschoor | |
| 3,669,117 A | | 6/1972 | Herbst | |
| 4,447,164 A | * | 5/1984 | Berndt | A61J 17/103 374/E13.002 |
| 4,983,122 A | | 1/1991 | Mitnick | |
| 5,013,321 A | | 5/1991 | MacVane | |
| 5,300,089 A | | 4/1994 | Sassin | |
| 5,342,398 A | | 8/1994 | Sun | |
| 5,395,392 A | * | 3/1995 | Suhonen | A61J 7/0053 606/234 |
| 5,494,441 A | | 2/1996 | Nicholson | |
| 5,606,871 A | | 3/1997 | Hansen et al. | |
| 5,658,314 A | | 8/1997 | Scheffer et al. | |

(Continued)

FOREIGN PATENT DOCUMENTS

WO 2017176697 A1 10/2017

*Primary Examiner* — Katherine M Shi
(74) *Attorney, Agent, or Firm* — AMSTER, ROTHSTEIN & EBENSTEIN

(57) ABSTRACT

A pacifier for cooling of oral tissue including: a nipple having an outer shell forming an outer chamber which is configured to retain a first cooling medium having a freezing temperature below 0 degrees Celsius, an inner shell forming an inner chamber positioned inside the outer chamber and which is configured to retain a second cooling medium having a freezing temperature above the freezing point temperature of the first cooling medium to assist in chilling the first cooling medium; a handle coupled to a proximate end of the nipple; and a shield positioned between the handle and the proximate end of the nipple.

27 Claims, 3 Drawing Sheets

(56) References Cited

U.S. PATENT DOCUMENTS

| | | | | |
|---|---|---|---|---|
| 5,700,279 | A | 12/1997 | Blando | |
| 6,176,380 | B1 * | 1/2001 | Glories | A61J 11/02 215/11.4 |
| 7,029,491 | B2 | 4/2006 | Davis | |
| 7,500,984 | B2 | 3/2009 | Fuisz et al. | |
| 8,544,676 | B2 | 10/2013 | Roth et al. | |
| 8,985,357 | B1 * | 3/2015 | Strayer | A61J 7/0053 604/218 |
| 9,314,126 | B2 | 4/2016 | Molayem | |
| 10,376,103 | B2 | 8/2019 | Rizzuto | |
| 2002/0129816 | A1 * | 9/2002 | Williams | A61B 1/24 128/200.24 |
| 2003/0014078 | A1 | 1/2003 | Robbins | |
| 2003/0093121 | A1 * | 5/2003 | Randolph | A61J 11/006 606/236 |
| 2003/0176891 | A1 | 9/2003 | Frederic | |
| 2006/0155331 | A1 | 7/2006 | Bohmer | |
| 2007/0208379 | A1 | 9/2007 | Kessler et al. | |
| 2009/0005810 | A1 | 1/2009 | Bonazza | |
| 2009/0312823 | A1 | 12/2009 | Patience et al. | |
| 2011/0029017 | A1 | 2/2011 | Shreve | |
| 2013/0085530 | A1 | 4/2013 | Caputo | |
| 2013/0138185 | A1 | 5/2013 | Paxman et al. | |
| 2013/0140315 | A1 | 6/2013 | Ni | |
| 2013/0245729 | A1 | 9/2013 | Edelman et al. | |
| 2013/0338711 | A1 * | 12/2013 | Strazzeri | A61J 17/02 264/28 |
| 2014/0276354 | A1 | 9/2014 | Piergallini et al. | |
| 2015/0257982 | A1 | 9/2015 | Antinnes | |
| 2015/0374588 | A1 | 12/2015 | Strazzeri | |
| 2017/0020722 | A1 | 1/2017 | Maher | |
| 2017/0354535 | A1 | 12/2017 | Yoskowitz | |
| 2018/0116913 | A1 | 5/2018 | Uitbeijerse | |
| 2018/0140407 | A1 | 5/2018 | Yoskowitz | |
| 2018/0169504 | A1 | 6/2018 | Williams | |
| 2020/0069459 | A1 | 3/2020 | Yoskowitz | |

* cited by examiner

PACIFIER FOR COOLING OF ORAL TISSUE

CROSS REFERENCE TO RELATED APPLICATION

This patent application claims the benefit of U.S. Provisional Application No. 62/946,833, filed Dec. 11, 2019, the content of which is incorporated by reference herein in its entirety.

FIELD OF THE INVENTION

The present innovation relates to a pacifier for cooling oral tissue, for example, of an infant or child, and more particularly, but not exclusively, for cooling and numbing the gums during teething or other oral treatment in which significantly lowering the temperature of the oral tissue Can reduce inflammation and/or provide immediate relief from pain.

BACKGROUND OF THE INVENTION

Young children or "babies", which generally include newborns, infants (e.g., 2 months to a year) and toddlers (e.g., 1-4 years), typically begin teething between the ages of 6 to 24 months. During this time, the child will often feel discomfort due to the inflammation and tenderness associated with the teeth breaking through the gums in their mouth. Various medical treatments can include giving the child an appropriate dose of acetaminophen, ibuprofen, and/or other over-the-counter medications to help numb any pain or discomfort. Alternatively, a doctor can prescribe a prescription drug in severe cases.

Many parents and caretakers prefer natural means to help relieve the pain the child experiences during teething. There are many home remedies for relieving pain that occurs from teething which can be easily found in well-known child-care publications or over the internet. Such home remedies can include massaging the child's gums, wiping excessive drool away, applying vanilla extract, ginger, or oils (e.g., clove or lavender), among many other homeopathic remedies. In addition, cooling of the mouth and the gums has often been found to be very effective to reduce or numb pain emanating from the gums. Ice packs or chilled washed cloths are often applied externally and/or internally. However, they do not evenly cool the mouth and gums. Alternatively, the child can be given a frozen bottle, chilled spoon, frozen banana, an ice pop or other chilled/frozen food substance, among other well-known remedies to reduce inflammation and alleviate pain from the gums.

There are numerous pacifiers and teething devices (teething rings) known in the art that retain a liquid which can be selectively chilled or frozen by a parent/caretaker. For example, U.S. Pat. Nos. 3,669,117, 5,300,089, 5,606,871, 5,658,314, and patent application publication nos. 2003/0176891, 2007/0208379, and 2015/0257982 disclose various embodiments of pacifiers/teething devices having a hollow, compressible, nipple portion which are manually filled with water, gel or other liquid coolant or solution, sealed and then cooled in a refrigerator or freezer prior to use. Although such pacifiers and other cooling devices and remedies provide relief to a child during teething, the length of time that the devices can retain their optimum cold temperatures is limited due to the opposing warming effects from being inserted in the child mouth during use, as well as the ambient air temperature of the surrounding environment (e.g., bedroom, kitchen, etc.). Moreover, a cooling device or other well-known remedy that is frozen solid and placed on the gums of the child can also be an unpleasant experience because of the tenderness and sensitivity of the gums to a rough and/or hard texture of the frozen surface, as well as the sudden and substantial temperature drop felt when placing the frozen device in the child's mouth.

Thus, in view of the inadequacies of the prior art devices and the other well-known treatments/remedies, there is a need for a pacifier to comfortably and effectively cool oral tissue in the mouth of a child for longer durations, and thereby minimize pain caused by, e.g., inflammation and tenderness of the gums which can occur when a child teethes. Furthermore, there has been a need for pacifier that remains comforting to the child throughout the duration of its application to the gums so that relaxation and even sleep can be obtained.

SUMMARY OF THE INNOVATION

The disadvantages heretofore associated with the prior art are overcome by the present innovation of a pacifier for cooling of oral tissue comprising: a nipple having an outer shell forming an outer chamber which is configured to retain a first cooling medium having a freezing temperature below 0 degrees Celsius, an inner shell forming an inner chamber positioned inside the outer chamber and which is configured to retain a second cooling medium having a freezing temperature above the freezing point temperature of the first cooling medium to assist in chilling the first cooling medium; a handle coupled to a proximate end of the nipple; and a shield positioned between the handle and the proximate end of the nipple.

In one aspect, the outer shell surrounds the inner shell to define a gap therebetween in which the first cooling medium is retained. The outer shell can be fabricated from a liquid-impervious and malleable material. For example, the outer shell can be fabricated from silicon.

In another aspect, the inner shell can be fabricated from a liquid-impervious and malleable material. For example, the inner shell can be fabricated from silicon.

In yet another aspect, the first cooling medium stored in the outer chamber is salt water. In another aspect, the second cooling medium stored in the inner chamber is water. In one embodiment, the first cooling medium stored in the outer chamber is salt water and the second cooling medium stored in the inner chamber is water. Alternatively, the first cooling medium stored in the outer chamber is a gel. In yet another embodiment, the first cooling medium stored in the outer chamber is a gel and the second cooling medium stored in the inner chamber is water.

In one aspect, the shield is positioned in a direction normal to a longitudinal axis extending through the nipple. In another aspect, the shield is positioned in a direction substantially normal to a longitudinal axis extending through the nipple.

In yet another aspect, the outer shell includes an outwardly extending first flange and the inner shell includes an outwardly extending second flange, the first and second outwardly extending flanges being arranged such that the second outwardly extending flange is positioned between the first outwardly extending flange and the shield. The first and second outwardly extending flanges are secured to the shield by a cap positioned over the first outwardly extending flange to thereby seal the outer and inner chambers closed.

In still another aspect, the first and second outwardly extending flanges are in a keyed mating arrangement. Moreover, the shield and second outwardly extending flange can be in a keyed mating arrangement. In another aspect, the cap and the first outwardly extending flange are in a keyed mating arrangement.

In one aspect, the cap includes a shoulder circumscribing the first and second outwardly extending flanges and configured and dimensioned to seal the outer and inner shells closed. In another aspect, the handle is formed from a malleable material. The handle can be fabricated from silicon.

In yet another aspect, the pacifier comprises a breathing tube extending through the nipple and shield. In another aspect, the pacifier further comprises a first port for filling the outer chamber with the first cooling medium and a second port for filling the inner chamber with the second cooling medium. In one aspect, the first port is formed in the handle. In yet another aspect, the second port is formed in the shield. In still another aspect, the first and second ports are formed in the shield.

In one aspect, the nipple comprises a distal end configured for placement against the oral tissue of a child. In another aspect, the oral tissue is the gums of the child.

Figure 1:
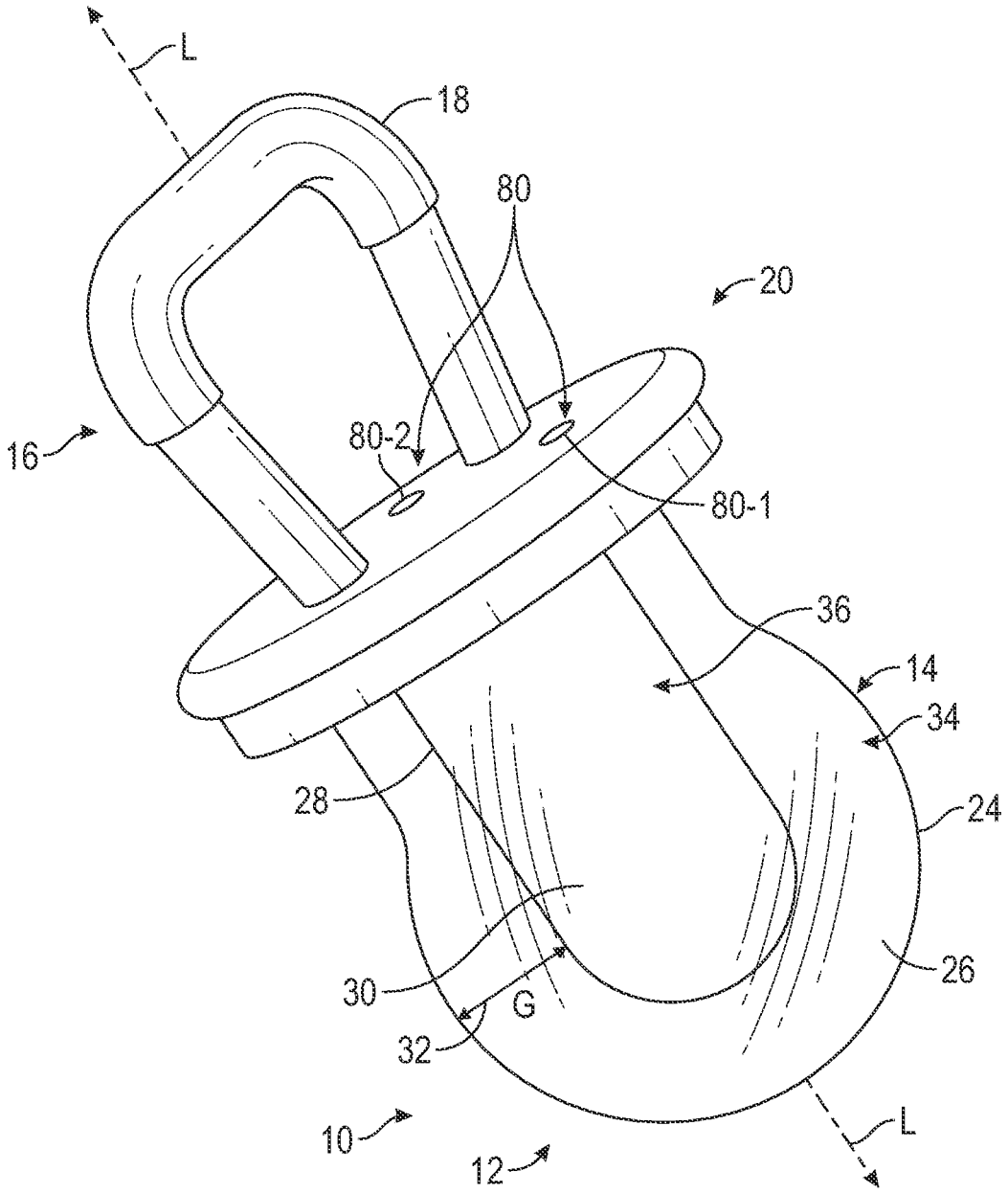
FIG. 1 is a top, side, perspective view of a pacifier having nipple formed by a pair of shells respectively defining a pair of chambers which are filled with cooling mediums in accordance with the present innovation, and that can be chilled prior to insertion into a child's mouth.

To facilitate an understanding of the innovation, identical reference numerals have been used, when appropriate, to designate the same or similar elements that are common to the figures. Further, unless stated otherwise, the features shown in the figures are not drawn to scale, but are shown for illustrative purposes only.

DETAILED DESCRIPTION OF THE PREFERRED EMBODIMENTS

The present innovation will now be described in detail with reference to the drawings.

FIG. 1 illustrates an embodiment of a pacifier 10 in accordance with the present innovation which can be inserted within the mouth of an infant or toddler to relieve pain, burning and/or itching sensations emanating from the gums, for example, during teething. The pacifier 10 includes a first end 12 formed by a nipple 14, an opposing second end 16 formed by a handle 18 or teething ring, and a base 20 provided between the nipple 14 and the handle 18 in a well-known manner.

In one embodiment, the base 20 is illustratively formed by a shield 50 having a lower surface 52 and an opposing upper surface 54, and an optional cap 56, as described below in further detail with respect to FIGS. 2 and 3. The shield 50 is illustratively shown as being planar or substantially planar, but such configuration is not considered limiting, as the shield 50 can be concave-shaped with respect to the handle 18 or any other well-known curvilinear shape suitable to prevent the child from inadvertently inserting the entire pacifier 10 in the mouth and/or prevent choking on the pacifier 10.

The nipple 14 includes an outer hollow shell 24 defining a first or outer chamber 26 in which a second or inner hollow shell 28 is provided to define an inner chamber 30. The outer chamber 26 preferably retains a first cooling medium (e.g., salt water solution) 34 and the inner chamber 30 retains a second cooling medium (e.g., pure water) 36 to enable the chilling of the nipple 14 as discussed below in further detail. The first cooling medium 34 retained in the outer chamber 26 has a freezing temperature that is below the freezing temperature of the second cooling medium 36 retained in the inner chamber 30. In this manner, the liquid in the inner chamber 30 can preferably freeze solid, while the liquid solution in the outer chamber 26 will not freeze and will optimally remain in a slushy and softer state. Accordingly, the outer shell 24 of the nipple 14 which is applied to the gums of the child is soft and malleable, as opposed to being a frozen and rigid surface area. As well, the outer shell 24 is chilled sufficiently to soothe pain from the gums, but it is not at sub-freezing temperatures which can be uncomfortable during use and cause the child to reject the insertion of the pacifier 10 in the mouth.

Preferably, salt water and pure water are used as the first and second cooling mediums 34, 36, respectively, because of their safety and ready availability. In one embodiment, the salt water solution includes a mixture of salt in the range of 1% to 25% ratio. In another embodiment, the salt water solution includes a mixture of salt at a 10% ratio, which allows the solution to remain in liquid form down to about 17 degrees F. A person of ordinary skill in the art will appreciate that other types of solutions in which the freezing point of one solution is close to 0 degrees C. (i.e., the second cooling medium) and the other with a freezing point below 0 degrees C. (i.e., the first cooling medium) can be substituted either for the salt water, pure water or both. Although the pacifier 10 of the present innovation is configured to operate at chilled or freezing temperatures, the pacifier 10 can also be used by a child at ambient temperatures in a well-known manner.

The outer shell 24 and inner shell 28 are preferably fabricated from a non-porous material which is impervious to seepage of liquid therethrough and is malleable and biocompatible with the infant's oral tissues such as, for example, acrylic, latex, plastic, silicon and rubber. The shape of the outer shell 24 preferably conforms to and is preferably configured to maximize contact area with the gums of an infant. Further, the nipple 14 is selected to maintain its shape, yet also provide elasticity to allow the child to periodically squeeze the contents with his/her gums and thereby cause the flow of the first cooling medium (salt water solution) 34 within the outer chamber 26, which effects a massaging sensation on the gums. Moreover, movement of the salt water solution 34 within the outer chamber 26 helps increases contact with the inner shell 28 over time such that the frozen water 36 within the inner chamber 30 acts as a heat sink by convection to thereby enable the salt solution 34 in the outer shell 24 to stay colder for longer periods of time while inserted in the mouth of the child.

The outer shell 24 can be bulbous, oval, spoon shaped or any other curvilinear shape to preferably maximize contact area with the gums of the infant. A person of ordinary skill in the art will appreciate that such shapes are not considered as being limiting, as any other well-known shapes can be used to form the outer shell 24, i.e., the outer surface of the nipple 14, while still housing the inner shell 28 and its cooling medium contents 36 therein. Accordingly, the inner shell 28 is sized smaller than the outer shell 24 such that a gap "G" 32 is formed between the outer surface of the inner shell 28 and the inner surface of the outer shell 24. Preferably, the gap 32 surrounds the entire outer surface of the inner shell 28. In this manner, the inner shell 28 extends or is otherwise positioned freely inside the outer shell 24, which allows the second cooling medium 36 to expand during freezing and contract should the ice begin to melt. However, in other embodiments, the inner shell 28 can be attached to the inside surface of the outer shell 24 at one or more locations to maintain its relative position within the outer chamber 26. The inner shell 24 preferably has an elongated length and can have the same shape as the outer shell 28 or be shaped as a rectilinear or cylindrical rod and/or have a bulbous, oval or any other curvilinear shape, although such shapes are not considered limiting. In yet another embodiment, the inner shell 28 can be formed as one or more independent enclosures (not shown) that contain the second cooling medium 36 and which float freely within the outer shell 24 when the pacifier 10 is in an unfrozen state.

Figure 2:
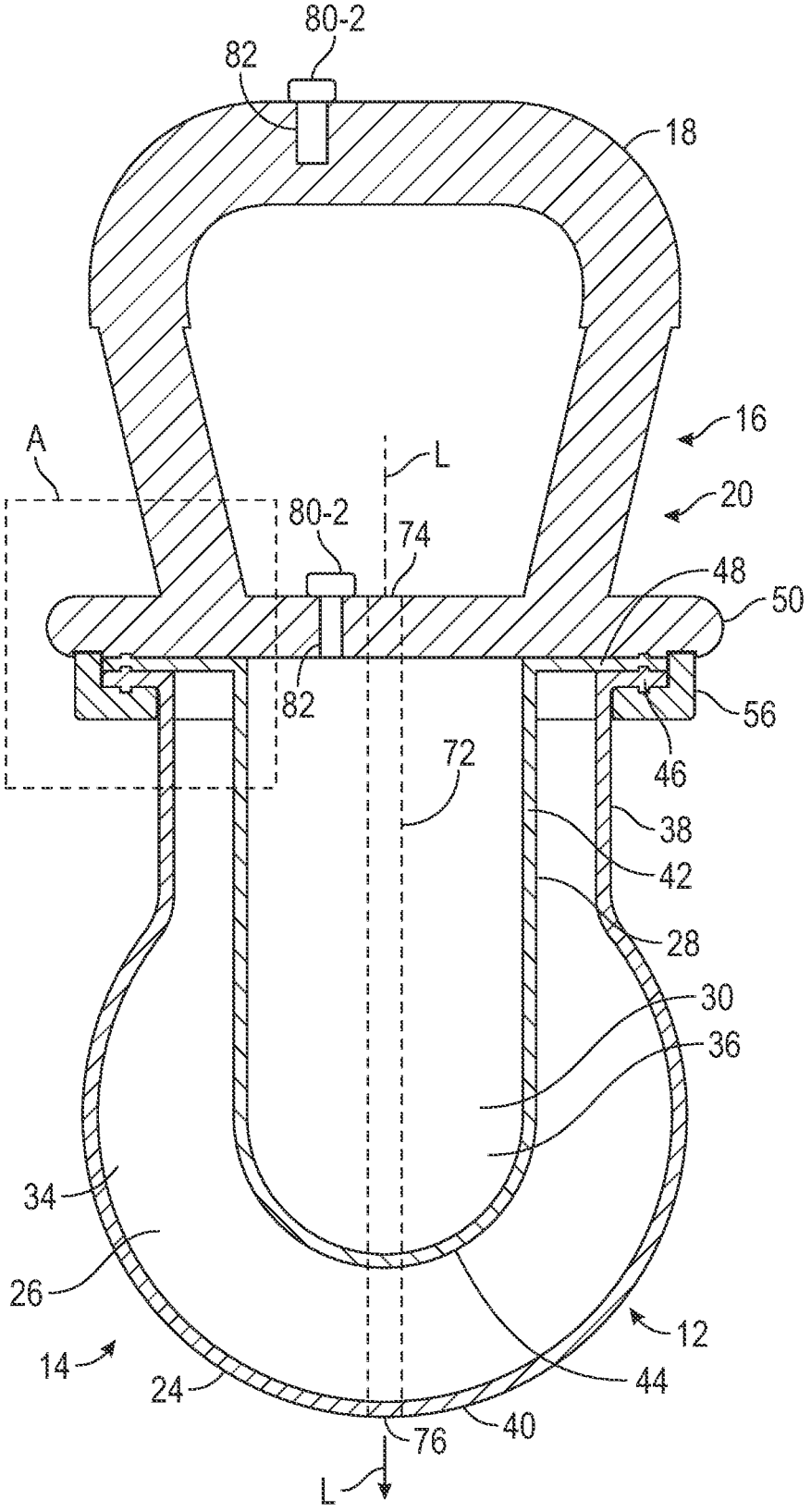
FIG. 2 is a cross-sectional view illustrating an arrangement of the dual-chambered nipple, a handle and a base, which is illustratively formed by a shield and sealing cap, as taken along a longitudinal axis of the pacifier of FIG. 1.
Figure 3:
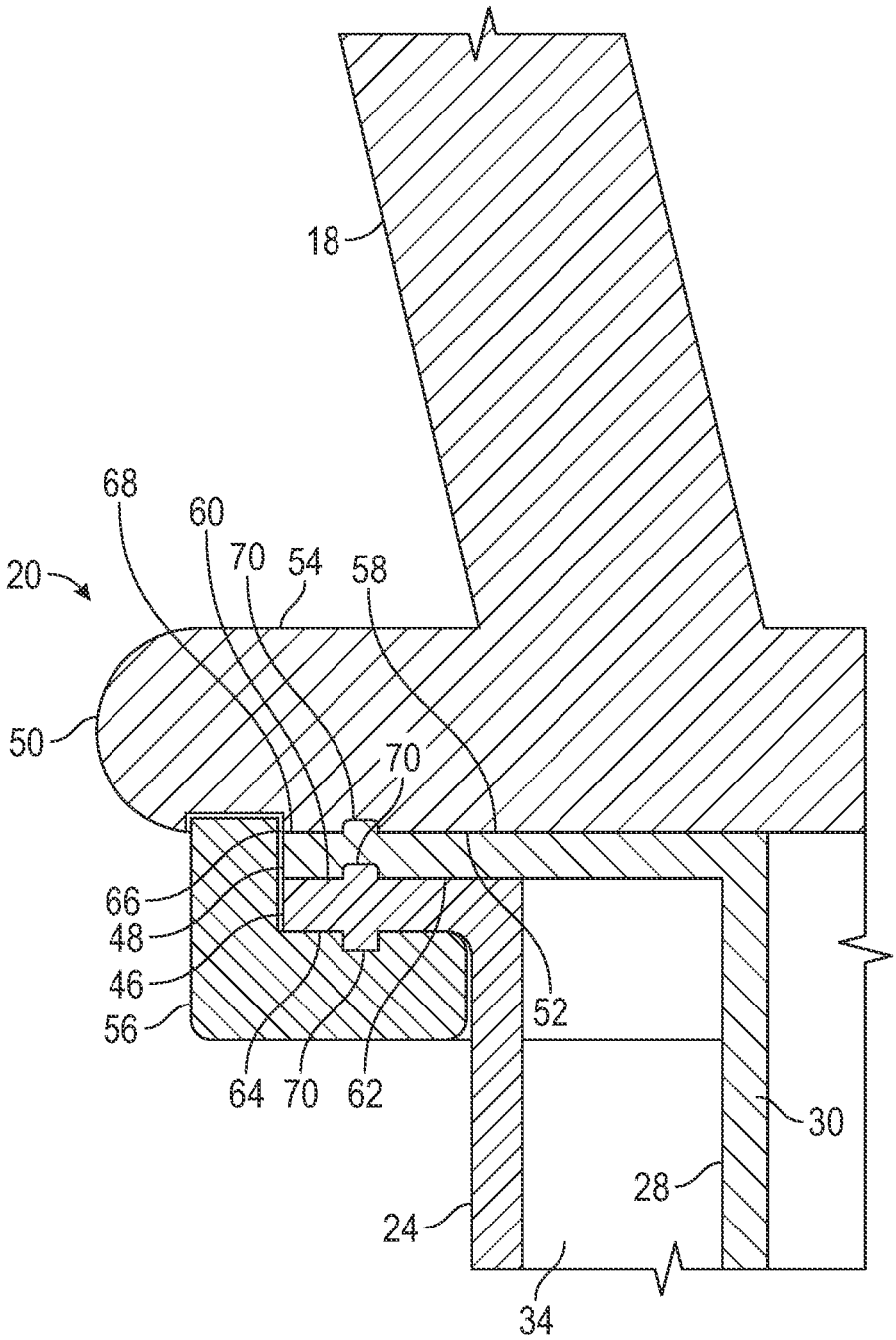
FIG. 3 is a left-side exploded view of the pacifier base taken from area "A" (drawn in phantom) of the pacifier of FIG. 2.

Referring to FIGS. 2 and 3, the outer shell 24 includes a proximal end 38 and a distal end 40 along the longitudinal axis "L" (FIG. 1) of the nipple 14. Similarly, the inner shell 28 includes a proximal end 42 and a distal end 44 along the longitudinal axis "L" of the nipple 14. The proximal ends 38, 42 of the outer and inner shells 24, 28 are adjoined to the base 20, and the distal ends 40, 44 of the outer and inner shells 24, 28 contain the first and second cooling mediums within the nipple 14, which is inserted into the mouth of the child during use. The proximal ends 38, 42 of the outer and inner shells 24, 28 each terminate with an outwardly extending flange 46, 48 respectively. The outwardly extending flange 46, 48 preferably extend around the entire perimeter outer and inner shells 24, 28, respectively, although such configuration is not considered limiting.

Referring now to the enlarged view of the base 20 as shown in FIG. 3, the outwardly extending flanges 46, 48 extend in a direction normal or substantially normal to the longitudinal axis L of the nipple 14. Although, the peripheral edges of the flanges 46, 48 are illustratively shown radiating to a same length from the central longitudinal axis L, such configuration is not considered as limiting, as the first and second flanges 46, 48 can have differing lengths from the longitudinal axis L. For example, the first flange 46 can radiate further than and overlap the second flange 48, or vice versa.

The outer shell 24 and its outwardly extending flange 46 are positioned over the inner shell 28 and its outwardly extending flange 48 in a stacked or nested arrangement. Illustratively, an inner surface 58 of the outwardly extending flange 48 of the inner shell 28 is positioned adjacent to the lower surface 52 of the shield 50, while an inner surface 62 of the outwardly extending flange 46 of the outer shell 24 is positioned adjacent to an outer surface 60 of the outwardly extending flange 48 of the inner shell 28. Preferably, the inner and outer surfaces 52, 58, 60, 62, 64 of the shield 50 and flanges 46, 48 are in a keyed arrangement 70 such that the adjacent surfaces are locked together to help seal the respective liquid contents within the chambers 34, 36 therein. In the embodiment shown in the drawings, a tongue and groove arrangement is provided between the inner surface 52 of the shield 50 and the inner surface 58 of the second outwardly extending flange 48. Similarly, a tongue and groove arrangement is provided between the outer surface 60 of the second outwardly extending flange 48 and the inner surface 62 of the first outwardly extending flange 46. Although the tongue and groove arrangement preferably circumscribes both the inner and outer surfaces 52, 58, 60, 62, 64 of the shield 52 and flanges 46, 48, such keying arrangement 70 is not considered limiting, as persons of ordinary skill in the art will appreciate that other keying arrangements can be implemented. For example, one or more paired sets of recesses and dimples, or other mating elements can be provided to maintain the positioning of the outer shell 24, inner shell 28 and shield 50 with respect to each other. The inner surface 52 and the inner/outer surfaces of the flanges 46, 48 can be bonded and sealed together in a water-tight manner by welding, with an adhesive sealant or any other well-known fastener.

For example, a cap 56 can be optionally mounted over the outer surface 64 of the first flange 46 of the outer shell 24 to lock the outer and inner shells 24, 28 to the shield 50. The cap 56 can include a shoulder 66 which circumscribes the edges of the flanges 46 and 48. The shield 50 can include a recess (not shown) formed in the lower surface 52 in which the stacked flanges 46 and 48 are inserted into, and the cap 56 is attached over the outer surface 64 of the first flange 46 to tightly secure both flanges 46, 48 to the shield 50 so that the first and second cooling mediums 34, 36 cannot leak out of the respective chambers 26 and 30. The cap 56 can be threaded or otherwise fastened to the shield 50 in a water-tight manner to secure the flanges against each other and the inner surface 52 of the shield 50. In one embodiment, the shoulder 66 of the cap 56 is threaded over an edge 68 of the shield 50. In another embodiment, an inner surface 70 of the cap 56 is in a keyed arrangement 70 with the outer surface 64 of the first flange 48 and is secured thereto by an adhesive or other sealant. A person of ordinary skill in the art will appreciate that the cap 56 can be secured to the shield 50 via a screw-fit arrangement, a snap-fit arrangement, a heat activated adhesive, and/or any other type of mechanical and/or bonding agent or adhesive.

As well, a person of ordinary skill in the art will appreciate that the flanges 46, 48 can be both bonded together and secured with the shield 50 with or without implementing the cap 56. Alternatively, the flanges 46 and 48 can float between the inner surface 70 of the cap 56 and the inner surface 52 of the shield 50 without the use of an adhesive or sealant. In this embodiment, the cap 56 is tightly secured over the flanges 46, 48 and to the shield 50, such that the tongue and groove or other keyed arrangement 70 provided between the shield 50, flanges 46, 48 and cap 56 maintains separation of the first and second coolant mediums without leakage therebetween or from the pacifier 10.

Referring to FIG. 1, the handle 18 is attached to or is integral with the upper surface 54 of the shield 50. The handle is preferably tubular in shape and configured so that the child can grip the handle by hand. A person of ordinary skill in the art will appreciate that the handle 18 can be circular or any other curvilinear shape, and can be used by the child as a teething ring in addition to the nipple 14 of the pacifier 10.

As discussed above, the outer shell 24 and inner shell 28 are preferably fabricated from a non-porous material which is impervious to seepage of liquid therethrough and is malleable and biocompatible with the infant's oral tissues such as, for example, acrylic, plastic, silicon, rubber and/or combinations thereof. Similarly, the base 20 (i.e., shield and optional cap) and handle 18 are also fabricated from the same or similar biocompatible, non-porous and malleable materials. A person of ordinary skill in the art will appreciate that during use, the pacifier 10 can be subjected to a broad range of temperatures, such as freezing temperatures e.g., −25 degrees C. to much hotter temperatures, e.g., 110 degrees C. when being sanitized (e.g., boiled in water). Accordingly, the selected materials and bonding agents used to fabricate the pacifier 10 are able to withstand such temperature swings and sustain the water-tight, malleable and biocompatible characteristics throughout the life expectancy of the pacifier 10.

Prior to use, the pacifier 10 is stored in a freezer or other temperature controlled environment in order to cool the cooling mediums to a desired temperature. The pacifier is then inserted in the child's mouth when the child is feeling irritable or experiencing pain from teething. Advantageously, the adjacently positioned or nested arrangement of the dual chambers 26, 30 in the nipple 14 enables the cooling medium in the outer chamber 30 to maintain the desired cooling temperature for longer periods of time when the pacifier 10 is inserted in the child's mouth, as compared to the prior art pacifiers with nipples having a single chamber filled with a coolant substance therein. During use, the nipple 14 can be positioned to maximize contact and cool selected oral tissues, e.g., the gums within the child's mouth. The first cooling medium 34 transfers heat from the oral tissue of the child to the colder inner cooling medium 36 to thereby keep the oral tissues colder for longer periods of time during use.

Preferably, the first cooling medium 34 is maintained at a temperature of approximately 0 degrees C. to approximately 5 degrees C. The cooling mediums 34, 36 are carried by the device in the sealed chambers 26, 30, and the device is cooled in a freezer or other cooling device to the proper temperature prior to use. The cooling medium may be a non-toxic gel or a like substance made by adding, for example, hydroxyethyl cellulose (CELLUSIZE™), sodium polyacrylate, or vinyl-coated silica gel that can maintain its initial temperature.

In one embodiment, the material used for the surfaces of the pacifier can be somewhat more rigid than the flexible surface forming the outer shell 24 to increase durability and better maintain the desired shape of the other pacifier components during use. In any of the embodiments, the materials used to fabricate the pacifier 10 are selected to be sufficiently durable and suitable to maintain a water-tight seal during use by a child. Moreover, the selected materials are able to withstand external forces that may be applied to the pacifier, such as when the child bites down on the pacifier, and the like. Illustratively, a metallic mesh material can be embedded within the external surfaces to prevent puncturing or other possible damage that could cause a leak to occur. In any event, should a leak occur, there is no harm to the patient because the contents are non-toxic and preferably include water, salt, and/or other harmless, non-toxic substances. As well, a person of ordinary skill in the art will appreciate that the pacifier 10 can be manufactured in a variety of sizes to accommodate different mouth cavity sizes for children of various ages, i.e., generally ranging from 6 months to two years.

In yet another embodiment, one or more breathing tubes 72 can be formed through the upper surface 54 of the shield 50 and extend through the inner shell 28 and the distal end 40 of the outer shell 24, as illustratively shown by the pair of lines drawn in phantom in FIG. 2. The breathing tube 72 as a first opening 74 illustratively formed at the center of the shield 50 and a second opening 76 formed in the distal end 40 of the outer shell 24 along the longitudinal axis L. The breathing tube 72 is preferably formed as cylindrical straw to enable breathing through the nipple 14 via the child's mouth. A person of ordinary skill in the art will appreciate that the shape and positioning of the breathing tube 72 through the shield 50 and nipple 14 as shown in FIG. 2 is not considered limiting.

In still another embodiment, the first and second cooling mediums 34, 36 can be manually filled into the outer and inner shells 24, 28, respectively of the pacifier 10 by the caretaker. Referring to FIG. 1, a first port 80-1 is formed through the shield 50 at a position aligned over the outer chamber 26 and a second port 80-2 is formed through the shield 50 at a position aligned over the inner chamber 30. The ports 80-1, 80-2 (collectively ports 80) serve as inlets/outlets for manually filling and emptying the chambers 26, 30. Each port 80 includes a seal 82 (e.g., cap, plug and the like, see FIG. 2), which can be manually opened/closed (e.g., removed/reinserted) in the ports 80. In an alternative embodiment, the first port 80 and corresponding seal 82 can be positioned in a tubular (hollow) handle 18 to enable the filling/emptying of the first cooling medium 34 into the outer chamber 26. A person of ordinary skill in the art will appreciate that the number and positioning of the coolant ports 80 is not considered limiting. For example, the handle 18 can be an asymmetrically-shaped, tubular (hollow) handle with one end attached to the shield 50 at a position that is aligned over the outer chamber 26 as illustratively shown in FIGS. 2 and 3, and an opposing second end of the tubular handle 18 attached to the shield 50 at a position that is aligned over the inner chamber 30 (second handle end positioning not shown). Each end of the tubular handle includes an inlet 80 with a seal 82 to enable manual filling/emptying of the inner and outer chambers 26, 30 with the first and second cooling mediums 34, 36, respectively.

In still another embodiment, the cap 56 can be unthreaded from the shield 50 to expose the upper portions of the outer and inner chambers 26, 30 proximate their respective flanges 46, 48. The first and second cooling mediums 34, 36 can be manually poured into the chambers 26, 30, and the cap 56 is then slid over the outer shell 24 and threaded back onto the shield 50 to close off and seal the chambers 26, 30. In any of the refillable outer/inner chamber embodiments, the contents of the outer and inner chambers 26, 30 can be replenished with fresh first and second cooling mediums 34, 36, as deemed necessary by the caretaker.

The foregoing description of the preferred embodiment of the innovation has been presented to illustrate the principles of the innovation and not to limit the innovation to the particular embodiment illustrated. It is intended that the scope of the innovation be defined by all of the embodiments encompassed within the following claims, and their equivalents.

The invention claimed is:

1. A pacifier for cooling of oral tissue of a child comprising:

a nipple having an outer shell forming an outer chamber which retains a first cooling medium having a freezing point temperature below 0 degrees Celsius, an inner shell forming an inner chamber positioned inside the outer chamber and which retains a second cooling medium having a freezing point temperature above the freezing point temperature of the first cooling medium to assist in chilling the first cooling medium;

a handle coupled to a proximate end of the nipple; and a shield positioned between the handle and the proximate end of the nipple.

2. The pacifier according to claim 1, wherein the outer shell surrounds the inner shell to define a gap therebetween in which the first cooling medium is retained.

3. The pacifier according to claim 1, wherein the outer shell is fabricated from a liquid-impervious and malleable material.

4. The pacifier according to claim 3, wherein the outer shell is fabricated from silicon.

5. The pacifier according to claim 1, wherein the inner shell is fabricated from a liquid-impervious and malleable material.

6. The pacifier according to claim 5, wherein the inner shell is fabricated from silicon.

7. The pacifier according to claim 1, wherein the first cooling medium in the outer chamber is salt water.

8. The pacifier according to claim 7, wherein the second cooling medium in the inner chamber is water.

9. The pacifier according to claim 1, wherein the first cooling medium in the outer chamber is salt water and the second cooling medium in the inner chamber is water.

10. The pacifier according to claim 1, wherein the first cooling medium in the outer chamber is a gel.

11. The pacifier according to claim 1, wherein the first cooling medium in the outer chamber is a gel and the second cooling medium in the inner chamber is water.

12. The pacifier according to claim 1, wherein the shield is positioned in a direction normal to a longitudinal axis extending through the nipple.

13. The pacifier according to claim 1, wherein the shield is positioned in a direction substantially normal to a longitudinal axis extending through the nipple.

14. The pacifier according to claim 1, wherein the outer shell includes a first outwardly extending first flange and the inner shell includes a second outwardly extending second flange, the first and second outwardly extending flanges being arranged such that the second outwardly extending flange is positioned between the first outwardly extending flange and the shield.

15. The pacifier according to claim 14, wherein the first and second outwardly extending flanges are secured to the shield by a cap positioned over the first outwardly extending flange to thereby seal the outer and inner chambers closed.

16. The pacifier according to claim 15, wherein the cap and the first outwardly extending flange are in a keyed mating arrangement.

17. The pacifier according to claim 15, wherein the cap includes a shoulder circumscribing the first and second outwardly extending flanges and configured and dimensioned to seal the outer and inner shells closed.

18. The pacifier according to claim 14, wherein the first and second outwardly extending flanges are in a keyed mating arrangement.

19. The pacifier according to claim 14, wherein the shield and the second outwardly extending flange are in a keyed mating arrangement.

20. The pacifier according to claim 1, wherein the handle is formed from a malleable material.

21. The pacifier according to claim 1, wherein the handle is fabricated from silicon.

22. The pacifier according to claim 1, further comprising a breathing tube extending through the nipple and shield.

23. The pacifier according to claim 1, further comprising a first port for filling the outer chamber with the first cooling medium and a second port for filling the inner chamber with the second cooling medium.

24. The pacifier according to claim 23, wherein the first port is formed in the handle.

25. The pacifier according to claim 24, wherein the second port is formed in the shield.

26. The pacifier according to claim 23, wherein the first and second ports are formed in the shield.

27. The pacifier according to claim 1, wherein at least one of the first and second cooling mediums is selectively retained, respectively, in at least one of the outer and inner chambers.

* * * * *